US011319515B2

(12) United States Patent
Pulina

(10) Patent No.: US 11,319,515 B2
(45) Date of Patent: May 3, 2022

(54) HEAVY-DUTY LAUNDRY DETERGENT WIPE WITH CONTROLLED ACTIVATION OF THE WASHING ACTIVE SUBSTANCES

(71) Applicant: COIN CONSULTING GMBH, Menden (DE)

(72) Inventor: Michael Pulina, Krefeld (DE)

(73) Assignee: Coin Consulting GmbH, Menden (DE)

( * ) Notice: Subject to any disclaimer, the term of this patent is extended or adjusted under 35 U.S.C. 154(b) by 180 days.

(21) Appl. No.: 16/476,416

(22) PCT Filed: Jan. 7, 2018

(86) PCT No.: PCT/EP2018/050302
§ 371 (c)(1),
(2) Date: Jul. 8, 2019

(87) PCT Pub. No.: WO2018/127578
PCT Pub. Date: Jul. 12, 2018

(65) Prior Publication Data

US 2020/0017805 A1 Jan. 16, 2020

(30) Foreign Application Priority Data

Jan. 8, 2017 (DE) ..... 10 2017 200 139.9

(51) Int. Cl.
*C11D 17/04* (2006.01)
*C11D 11/00* (2006.01)
*C11D 10/04* (2006.01)

(52) U.S. Cl.
CPC ..... *C11D 17/046* (2013.01); *C11D 10/045* (2013.01); *C11D 11/0017* (2013.01)

(58) Field of Classification Search
CPC .. C11D 17/046; C11D 11/0017; C11D 10/045
See application file for complete search history.

(56) References Cited

U.S. PATENT DOCUMENTS 6,376,447 B1 * 4/2002 Boutique ..... C11D 3/38618 510/371
2002/0006890 A1 * 1/2002 Sunder ..... C11D 17/041 510/446
2012/0096651 A1 * 4/2012 Tenbusch ..... H01L 35/32 8/137
2016/0208202 A1 * 7/2016 Himmrich ..... C11D 3/10
2016/0208204 A1 * 7/2016 Mausberg ..... C11D 17/049
2017/0130176 A1 * 5/2017 Mausberg ..... C11D 17/049
2018/0216042 A1 * 8/2018 Mausberg ..... C11D 3/128
2018/0320114 A1 * 11/2018 Pulina ..... D06B 1/12
2020/0017805 A1 * 1/2020 Pulina ..... C11D 17/046

FOREIGN PATENT DOCUMENTS

WO WO 2015/027970 A1 3/2015
WO WO 2015/192822 A1 12/2015
WO WO 2016/029894 A1 3/2016

OTHER PUBLICATIONS

International Search Reportand Written Opinion dated Mar. 16, 2018 in corresponding International Application No. PCT/EP2018/050302.

* cited by examiner

*Primary Examiner* — Nicole M. Buie-Hatcher
*Assistant Examiner* — M. Reza Asdjodi
(74) *Attorney, Agent, or Firm* — Haug Partners LLP

(57) ABSTRACT

The present invention discloses a method for manufacturing a four-phase heavy-duty laundry detergent wipe, characterized by the following steps: (a) manufacturing a liquid starting laundry detergent solution which contains enzymes, surfactants and at least one polyvalent alcohol as a solubilizer and which is present in a liquid phase; (b) incorporating soap in the liquid starting laundry detergent solution to obtain a liquid laundry detergent solution (A), wherein the liquid laundry detergent solution is two-phase due to oversaturation; (c) admixing at least two different washing active solid components to the liquid laundry detergent solution (A) which are insoluble in the polyvalent alcohols of step a) to obtain a laundry detergent dispersion (B) which contains the liquid over-saturated two-phase laundry detergent solution (A) from step b) as a liquid continuous outer binary phase and the at least two washing active solid components as a solid phase; (d) applying the laundry detergent dispersion (B) to a solid carrier substrate (C) such that the final product is a four-phase system. Furthermore, a four-phase heavy-duty laundry detergent wipe is disclosed, comprising a solid carrier substrate (C) and a laundry detergent dispersion (B) which has been applied to the carrier substrate, characterized in that the laundry detergent dispersion contains a liquid over-saturated two-phase laundry detergent solution (A), which contains enzymes, surfactants and soap and at least one polyvalent alcohol as a solubilizer, as a liquid continuous outer binary phase and at least two different washing active solid components as a solid phase which is insoluble in the solubilizer.

8 Claims, No Drawings

HEAVY-DUTY LAUNDRY DETERGENT WIPE WITH CONTROLLED ACTIVATION OF THE WASHING ACTIVE SUBSTANCES

CROSS-REFERENCE TO RELATED APPLICATIONS

This application is the National Stage entry under 35 U.S.C. § 371 of International Application No. PCT/EP2018/050302 filed on Jan. 7, 2018, published on Jul. 12, 2018 under Publication Number WO 2018/127578, which claims the benefit of priority under 35 U.S.C. § 119 of German Patent Application Number 10 2017 200 139.9 filed Jan. 8, 2017, the entireties of which are incorporated herein by reference.

FIELD OF THE INVENTION

The present invention is directed to four-phase heavy-duty laundry detergent wipes, which permit a controlled activation of the washing active substances and manufacturing methods therefor.

BACKGROUND OF THE INVENTION AND PRIOR ART

The pursuit of hygiene exists from the beginning of mankind. Hygiene eventually is an important aspect of everyday life. The hygienic approach primarily consists in maintaining the health. In addition to the general cleaning effects scent and improved cleaning power of the raw material compositions have also come under scrutiny due to extended possibilities. Cleaning power optimization is particularly characterized by the ability to extend a hygienically clean state and an improvement of the degree of cleaning.

Nowadays hygiene can be divided into the fields of body, surface and textile hygiene. The latter is divided into applications depending on textile material and color. At least since the Nineties of the $20^{th}$ century the consumer's awareness has been raised of ecological cleaning. In this regard, it is desirable to maintain the advantages of conventional washing detergents, on the one hand, and to find further innovative and ecologically feasible product solutions, on the other hand.

With the beginning of industrial production, laundry detergents have been realized as powders. This very day, a powder laundry detergent consists of a mixture of different washing active substances.

With the progress during the development of laundry detergents enzymes and other new surfactant compositions entered this market segment. In addition to the substances necessary for cleaning large amounts of filler material are added nowadays. Accordingly, no change of the consumer's dosing behavior was necessary. First attempts to omit filler material resulted in an overdosing of the surfactants due to the application the users were used to.

Then liquid washing detergents were introduced which could be dosed residue-free and, thus, offered a physical alternative to the mixture of solids of laundry detergents. However, up to now liquid washing detergents do not accomplish the cleaning level of a heavy-duty laundry detergent (i.e., a mixture of solids). This is due to the fact that a liquid washing detergent is limited to liquid components or components which are well soluble in water. The essential substance combination in washing detergent, however, is the combination of surfactants, enzymes, bleaching agents, soap (in a liquid detergent) and water softeners (zeolites).

Another important factor for optimal cleaning using a commercially available washing machine is the timely dosing of the washing active substances during the washing process. With common laundry detergents (powder and liquid laundry detergents) this is realized via the washing program or separate dosing chambers.

A current product trend is the way of portioning the washing detergent. This can be achieved, on the one hand, by packing a liquid washing detergent in small polymer pouches. In this case, all washing active substances are released at the time when the polymer pouch is dissolved.

Another physical modification of the washing detergent consists in mixing a washing detergent with a fatty alcohol in order to achieve desired forms. In this case, the washing active substances are released via the dissolution of the structure of the detergent/fatty alcohol mixture.

As disclosed in DE 10 2010 060 126 A1, a multi-phase product can be provided. The laundry detergent wipe disclosed therein is characterized by combining a carrier material with an impregnating liquid (two-phase product). The preferred use of hydrophilic carrier materials and solutions leads to an outwashing process which is comparable to the dissolution of the polymer pouches mentioned above in connection with liquid detergents packed in small polymer pouches. Only the activation at an earlier point in time could be observed.

DE 10 2013 014 015 A1 by the Applicant discloses a further optimized product, wherein a dispersion is applied to a substrate which is solid at ambient temperature, such that a three-phase system (solid-in-liquid)-on-solid is provided. Due to the use of a dispersion for the first time, a cleaning power with the features of a powdered washing detergent (zeolites, phyllosilicates) could be achieved. Primarily hydrophobic carrier substrates have been used because the laundry detergent dispersion also has hydrophilic characteristics due to higher amount of washing active substances as compared to the two-phase system. In this way, the activation of the washing active substances (phase emission diffusion) over a longer period could be observed.

Enzymes play an important role during cleaning. During cleaning they serve the purpose of removing stain in the groups of starch, egg yolk, egg white, blood, fat, butter, oil etc. Single use of surfactants does not permit a comparable stain removal in these categories because surfactants only effectuate the binding and the disposal of these stains from the textile surfaces in question. So far, in powdered detergents bleaching agents (oxygen donors and their activators) and enzymes can be used inside one formulation in spite of their chemical incompatibility because these educts are available in the physical form of a powder in solid and, thus, initially passive form. Dissolution of these components, however, results in an interaction which leads to the decomposition of the enzymes by the bleaching agents which can result in their deactivation.

To overcome this problem, DE 10 2014 008 586 A1 by the Applicant discloses a laundry detergent and, in particular, a laundry detergent wipe, wherein bleaching agents (oxygen donors and their activators) and enzymes can be used without their mutual incompatibility having any effect since the laundry detergent and laundry detergent wipe, resp., comprises a capsule system containing a waxy matrix which is surrounded by an ionic polymer layer and into which oxygen donors and their activators have been incorporated. The activation of the oxygen donors and their activators can be controlled by selecting the matrix material, which makes an effective use of enzymes and bleaching agents (oxygen donors and their activators) possible: At the beginning of the washing cycle, enzymes are released which start their performance from about 30° C. Only thereafter, the outer polymer layer of the waxy matrix is dissolved and molten, resp., during further heating using a washing program of at least 40° C. such that the oxygen donors and their activators are only activated at this later time, after the enzymes have already performed and possibly are no longer present due to washing active reduction or drainage in the washing program (e.g., after the pre-washing cycle). Accordingly, a time-delayed temperature dependent activation of the washing active substances (here, in particular, enzymes and bleaching agents, i.e., oxygen donors and their activators) in a laundry detergent and laundry detergent wipe is achieved.

However, the following problems still remain:

- the bleaching agents react with the enzymes in the aqueous solution.
- the bleaching agents are activated in water at temperatures of >40° C.,
- the soap has an alkaline pH level when dissociated, the bleaching agents, however, are not stable in the alkaline medium.

Accordingly, it is an object of the present invention to provide a laundry detergent product which permits an effectively controlled activation of bleaching agents and their activators and other washing active components, on the one hand, and an economical manufacturing and effective storage without loss in quality using the composition of a liquid detergent (being characterized by a significant amount of soap), on the other hand. Quality criteria are, e.g., the available active ingredients.

SUMMARY OF THE INVENTION

It is one object of the present invention, to provide a laundry detergent product which permits an effectively controlled activation of bleaching agents and their activators and other washing active components (surfactants, soap, water softeners, enzymes). It is a further object of the present invention, to provide a laundry detergent product which permits an economical manufacturing and effective storage without loss in quality.

These objects have been achieved by a method for manufacturing a four-phase heavy-duty laundry detergent wipe, characterized by the following steps: (a') optionally neutralizing a fatty acid to soap; (a) manufacturing a liquid non-aqueous starting laundry detergent solution which contains enzymes, surfactants and one or more polyvalent alcohols as a solubilizer and which is present in a liquid phase; (b) incorporating soap in the liquid starting laundry detergent solution to obtain a liquid laundry detergent solution; (c) admixing at least two different washing active solid components to the liquid laundry detergent solution which are insoluble in the polyvalent alcohols of step a) to obtain a laundry detergent dispersion which contains the liquid laundry detergent solution as a liquid continuous outer binary phase and the at least two washing active solid components as a solid phase; (d) applying the laundry detergent dispersion to a solid carrier substrate, preferably by a method for manufacturing a four-phase heavy-duty laundry detergent wipe, characterized by the following steps: (a') optionally neutralizing a fatty acid to soap; (a) manufacturing a liquid starting laundry detergent solution which contains enzymes, surfactants and one or more polyvalent alcohols as a solubilizer and which is present in a liquid phase; (b) incorporating soap in the liquid starting laundry detergent solution to obtain a liquid laundry detergent solution, wherein the liquid laundry detergent solution is two-phase due to over-saturation; (c) admixing at least two different washing active solid components to the liquid laundry detergent solution which are insoluble in polyvalent alcohols to obtain a laundry detergent dispersion which contains the liquid over-saturated two-phase laundry detergent solution as a liquid continuous outer binary phase and the at least two washing active solid components as a solid phase; (d) applying the laundry detergent dispersion to a solid carrier substrate such that the final product is a four-phase system.

These objects have also been achieved by a four-phase heavy-duty laundry detergent wipe, comprising a solid carrier substrate and a three-phase laundry detergent dispersion which has been applied to the carrier substrate, characterized in that the three-phase laundry detergent dispersion contains a liquid two-phase laundry detergent solution which is over-saturated with soap and which contains enzymes, surfactants and soap and at least one polyvalent alcohol as a solubilizer, as a liquid continuous outer binary phase and at least two different washing active solid components as a solid phase which is insoluble in the solubilizer.

Advantageous embodiments of the heavy-duty laundry detergent wipe according to the invention and its manufacturing method can be obtained from the dependent claims.

The term "laundry detergent solution" means, according to the invention, a composition comprising one or more biocatalysts, preferably enzymes or cell extracts, in particular, enzymes suitable for manufacturing laundry or cleaning detergents. Thus, the three-phase heavy-duty laundry detergent wipe according to the invention also contains one or more functional intact biocatalysts in its composition, in particular, enzymes.

The term "ambient temperature" means, according to the invention, a temperature range where biocatalysts are not inactivated irreversibly, preferably approx. 5-50° C., in particular preferably approx. 15-30° C.

According to the invention, the term "%" means, if not otherwise indicated, weight % (w/w).

The term "dispersion" means, according to the invention, preferably a suspension, in particular preferably a suspension with a liquid phase as the continuous phase which is, thus, two-phase liquid-liquid due to over-saturation. In a specific sense, it can be subsumed under coarse disperse suspensions.

The term "polyvalent alcohol" means, according to the invention, preferably a linear or branched-chain di- or trivalent alcohol with a carbon chain length of $C_3$-$C_{10}$, more preferably of $C_3$-$C_7$, in particular, propyleneglycol and glycerol. According to the invention, water and monohydric alcohols such as methanol, ethanol or propanol are excluded as solubilizers and as ingredients, resp., of the laundry detergent solution and the starting laundry detergent solution, resp.

The term "washing active solid components" means, according to the invention, preferably a) builder/water softeners such as, e.g., polycarboxylates, zeolites and/or phyllosilicates, as well as b) bleaching agents such as, e.g., percarbonates and/or encapsulated PAP, and c) their activators such as, e.g., TAED. This comprises only those builders/water softeners, bleaching agents and activators which are insoluble in the laundry detergent solution defined according to the invention or which are provided in a formulation ensuring that they are soluble in the laundry detergent solution defined according to the invention. "Washing active solid components" according to the invention are also coated and/or encapsulated washing active ingredients known to the expert which are soluble in the laundry detergent solution defined according to the invention.

The term "carrier substrate" means, according to the invention, a solid carrier substrate, preferably a carrier substrate which is solid at up to 100° C., which suitable as a laundry detergent wipe being impregnated with the laundry detergent solution defined according to the invention and which maintains its structure under mechanical and thermal load in a common household washing process such that, e.g., single fiber forming is avoided. Particularly preferred carrier substrates are—optionally derivatized—homopolymers such as polyethylene, polypropylene, polyester (e.g., polylactides), polyamides (e.g., polycaprolactam), or cellulose (viscose). Furthermore, these materials are preferred as endless fibers, endless filaments or solidified under high pressure.

The term "soap" means, according to the invention, preferably $Na^+$ or $K^+$ salts of $C_{10}$-$C_{18}$ fatty acids.

The term "over-saturation" means, according to the invention, an over-saturation of the laundry detergent solution by the amount of soap which—preferably after incorporating the soap into the laundry detergent solution—results in the formation of of a binary liquid phase of the laundry detergent solution, preferably at a temperature of less than 50° C., in particular, less than 35° C. The over-saturation is particularly achieved by a soap amount of between 1 and 30 weight %, preferably of between 5 to 25 weight %, and even more preferably of between 10 to 20 weight % in relation to the weight of the laundry detergent solution (i.e., without solids).

DESCRIPTION OF THE PREFERRED EMBODIMENTS

The present invention provides a new system for the controlled release of bleaching agents and other washing active components in the form of a laundry detergent wipe. Wet wipes according to the state of the art always contains water or ethanol (for surface cleaning) in order to permit the application of a low-viscosity solution/lotion on a non-woven. These substances have a high polarity (high hydrophily) and function as a solubilizer of surfactants, preserving agents and emulsifiers. For this reason, carrier materials (non-wovens) with hydrophilic fibers and high capillary forces, resp., are used in order to achieve a homogenous impregnation and a high degree of impregnation.

For the general structure and manufacturing—with the exception of the specific composition of the laundry detergent solution defined by the present invention—of the heavy-duty laundry detergent wipe according to the present invention, it is referred to DE 10 2013 014 015 A1 and DE 10 2014 008 586 A2 by the Applicant. With the heavy-duty laundry detergent wipe according to the present invention, the controlled release of the bleaching agents and other washing active components only starts with the addition of water during the washing process.

According to the present invention—and in contrast to the heavy-duty laundry detergent wipe according to DE 10 2013 014 015 A1 and DE 10 2014 008 586 A2 by the Applicant—this could be achieved by using a less polar liquid, in contrast to common solubilizer such as water, such that a plurality of the reactive components (bleaching agents, water softeners) is initially present in solid form (coarse disperse and/or colloidal disperse suspension). Suitable substances are polyvalent alcohols, in particular propyleneglycol or glycerol, since they have only a low toxicity and, thus, only cause a minor pollution to man, animal and environment. In common liquid laundry detergents water is used as the solubilizer and the polyvalent alcohols function as stabilizers, whereas, in the present invention, the latter are used as solubilizers (i.e., in the inventive laundry detergent solution and the heavy-duty laundry detergent). They are necessary in order to maintain the characteristics of a liquid laundry detergent—due to the avoidance of water, on the other hand, the amount of preserving agents can be considerably reduced which results in a better life cycle assessment, as far as the critical dilution volume (CDV) is concerned. Furthermore, the propyleneglycol determines the absorption behavior of the solid carrier substrate onto/into which the laundry detergent solution is applied and incorporated, resp. Particularly suitable for the carrier substrate is a hydrophobic monomolecular endless fiber and a fiber of endless filaments, resp., in particular polypropylene or polyethylene. In this respect, the heavy-duty laundry detergent wipe according to the present invention is particularly characterized by the fact that it neither contains water nor a monohydric alcohol.

The system according to the present invention has the following characteristics:

- Inhibition of undesired reactions between the washing active components (bleaching agents and the activators, enzymes, surfactants), as well as optionally with scent components (perfume) during storage.
- Activation of the washing active components above only with/after beginning the washing process in the detergent solution, initiated by adding water/raising temperature of a washing cycle to the heavy-duty laundry detergent wipe according to the present invention.
- Higher efficiency and effectivity of the heavy-duty laundry detergent wipe due to the higher amount of washing active substances in relation to the carrier substrate.

The invention also provides a method for manufacturing a four-phase heavy-duty laundry detergent wipe with a liquid "hydrophobic" phase. This method comprises the following steps:

(a') optionally neutralizing a fatty acid to soap:

(a) manufacturing a liquid starting laundry detergent solution which contains enzymes, surfactants and at least one polyvalent alcohol (e.g., propyleneglycol or glycerol) as a solubilizer (the manufacturing is performed analogously to the manufacturing of a laundry detergent solution containing water according to the prior art);

(b) incorporating soap (e.g., with a disperser or homogenizer) in the liquid starting laundry detergent solution to obtain a liquid laundry detergent solution A, wherein the liquid laundry detergent solution is two-phase due to over-saturation with soap (i.e., it demixes to two liquid phases at ambient temperature);

(c) admixing (e.g., with an Ystral mixer/disperser) at least two different washing active solid components (e.g., bleaching agents and/or their activators, as well as zeolites and/or phyllosilicates) to the liquid laundry detergent solution A which are insoluble in polyvalent alcohols to obtain a laundry detergent dispersion B which contains the liquid over-saturated two-phase laundry detergent solution A as a liquid continuous outer binary phase and the at least two washing active solid components as a solid phase:

(d) applying the laundry detergent dispersion B to a solid carrier substrate C.

The washing active components/ingredients preferred according to the present invention comprise the following classes of substances:

bleaching agents and/or their activators
coated or encapsulated bleaching agents and/or their coated or encapsulated activators
enzymes
coated or encapsulated enzymes
optical brighteners
surfactants
water softeners (e.g., zeolites, phyllosilicates a.o.)

Bleaching agents (oxygen donors and their activators) commonly used in laundry detergents and also in the heavy-duty laundry detergent wipes according to the present invention are:

perborates
hydrogen peroxide
phthalimido-peroxo-caproic acid
hypochlorides
TAED (tetraacetylethylenediamine)
chlorate
permanganate
percarbonate Enzymes commonly used in laundry detergents are:

protease
cellulase
lipase
amylase which are also used in the heavy-duty laundry detergent wipes according to the present invention.

According to the present invention, the laundry detergent suspensions and lotions, resp., consist of:

Heavy Duty Laundry Detergent Wipe (Universal):

| |
|---|
| anionic surfactants |
| nonionic surfactants |
| phosphonates/complex builders |
| C10-C18 fatty acid salts (soap) |
| optical brighteners |
| Enzymes |
| builders (polycarboxylates, zeolites, phyllosilicates) |
| solubilizers (propyleneglycol, glycerol) |
| Scents |
| soil-release polymer |

Color Laundry Detergent Wipe (Color):

| |
|---|
| anionic surfactants |
| nonionic surfactants |
| phosphonates/complex builders |
| C10-C18 fatty acid salts (soap) |
| Colorants |
| color transfer protection |
| hydrotropes (sodium cumenesulfonate) |
| Enzymes |
| builders (polycarboxylates, zeolites, phyllosilicates) |
| solubilizers (propyleneglycol, glycerol) |
| Scents |
| soil-release polymer |

Black Laundry Detergent Wipe (Black):

| |
|---|
| anionic surfactants |
| nonionic surfactants |
| phosphonates/complex builders |
| C10-C18 fatty acid salts (soap) |
| Colorants |

-continued

| |
|---|
| color transfer protection |
| Enzymes |
| builders (polycarboxylates, zeolites, phyllosilicates) |
| solubilizers (propyleneglycol, glycerol) |
| Scents |

White Laundry Detergent Wipe (White):

| |
|---|
| anionic surfactants |
| nonionic surfactants |
| C10-C18 fatty acid salts (soap) |
| optical brighteners |
| soil-release polymer |
| color transfer protection |
| Enzymes |
| builders (polycarboxylates, zeolites, phyllosilicates) |
| solubilizers (propyleneglycol, glycerol) |
| Colorants |
| Scents |

Fine Laundry Detergent Wipe:

| |
|---|
| anionic surfactants |
| nonionic surfactants |
| C10-C18 fatty acid salts (soap) |
| phosphonates/complex builders |
| color transfer protection |
| Enzymes |
| builders (polycarboxylates, zeolites, phyllosilicates) |
| solubilizers (propyleneglycol, glycerol) |
| Scents |
| Defoamers |

Wool Laundry Detergent Wipe:

| |
|---|
| anionic surfactants |
| nonionic surfactants |
| amphoteric surfactants |
| C10-C18 fatty acid salts (soap) |
| phosphonates/complex builders |
| color transfer protection |
| builders (polycarboxylates, zeolites, phyllosilicates) |
| solubilizers (propyleneglycol, glycerol) |
| Scents |
| Conditioners |

"Soil release polymers" (SRP) are hydrophilic polymers known to the expert which change surface properties of fibers and textiles for better dirt repellency. SRP protect clothing from deeper penetration of dirt in the textile fabrics. At the same time, they enhance the effectivity of the washing active substances used for textile cleaning. Furthermore, SRP impede repeated deposition of dirt during the washing process. Due to their effectivity already at low temperatures they also contribute to the reduction of energy consumption.

"Conditioners" are substances (e.g., polymers) known to the expert with cationic functional groups having a high substantivity on textile fabrics (e.g., wool, keratine a.o.). As a result, conditioners are deposited on the fibers and provide due to their functional features for different effects (hydrophobization, hydrophilization, etc.) in the conditioning of the textile fibers (e.g. in wool laundry detergents usually a smoothing, loosening and anti-pilling (Knubbelbildung) is desired).

The functional additive which is insoluble in the solubilizer such as propyleneglycol or glycerol and the washing active component, resp., of the laundry detergent dispersion and lotion, resp., contains at least two solids: the first one is a zeolite and/or phyllosilicate, the other one is given by the bleaching agent and/or its activators. The dispersion is statistically fixed to the hydrophobic carrier substrate.

Experiments showed that the stability during storage, the activity, as well as the resource efficiency could be enhanced if the bleaching agent was coated before. The coating is an enclosure of the washing active bleaching agent with a stable coating material. Many different coating materials are known to the expert and are disclosed in Applicant's DE 10 2014 008 586 A1. Depending on the chemical modification of the coating material, the kinetic characteristics concerning dissolution and availability over time can be controlled via the diffusion processes of the non-woven phase (i.e., the solid carrier material).

An optimal relation between the ingredients of the laundry detergent dispersion and lotion, resp., for manufacturing the "universal" variant of the heavy-duty laundry detergent wipe will be described below.

Manufacturing of a Liquid Over-Saturated Two-Phase Laundry Detergent Solution a in Concentrated Form

| Ingredient | Amount % |
|---|---|
| Propyleneglycol | ad 100 |
| C13-C15 fatty alcohol | 20.0000 |
| Dodecylbenzenesulfate | 15.0000 |
| Fatty acid | 10.0000 |
| NaOH | 8.4360 |
| Na Ethylhexylglycerol | 4.0000 |
| $Na_7H_3$[[bis[2-[bis(phosphonatomethyl)-amino]ethyl]amino]methyl]phosphonate | 3.0000 |
| $Na_4$ Iminodisuccinate | 1.9000 |
| Nonionic polymer (polyester/polyether copolymer) | 1.8000 |
| Protease | 1.5000 |
| Phenoxyethanol | 0.0325 |
| Perfume | 1.0000 |
| Disodium-2-2'-([1,1'-biphenyl]-4,4'-diyldivinylene)bis(benzenesulfonate) | 0.5000 |
| Alpha amylase | 0.4000 |
| Mannanase | 0.4000 |
| Benzisothiazolinone | 0.0061 |
| Pectat lyase | 0.3500 |
| Cellulase | 0.2000 |
| Lipase | 0.2000 |
| Methylisothiazolinone | 0.0045 |

Modification to Coarse Disperse Laundry Detergent Suspension B

| Ingredient | Amount % |
|---|---|
| Laundry detergent solution A | 94 |
| Zeolite | 5 |
| Bleaching agent (in particular Sodiumpercarbonate or PAP) | 1 |

Application of the Coarse Disperse Laundry Detergent Suspension B on Wipe C

| Ingredient | Amount gr. |
|---|---|
| Laundry detergent suspension B | 23 |
| Non-woven polypropylene | 5 |

The invention claimed is:

1. Method for manufacturing a four-phase heavy-duty laundry detergent wipe, characterized by the following steps:

(a) manufacturing a liquid starting laundry detergent solution which contains enzymes, surfactants and at least one polyvalent alcohol as a solubilizer and which is present in a liquid phase;

(b) incorporating soap in the liquid starting laundry detergent solution to obtain a liquid laundry detergent solution (A), wherein the liquid laundry detergent solution is two-phase due to over-saturation;

(c) admixing at least two different washing active solid components to the liquid laundry detergent solution (A) which are insoluble in the polyvalent alcohols of step a) to obtain a laundry detergent dispersion (B) which contains the liquid over-saturated two-phase laundry detergent solution (A) from step b) as a liquid continuous outer binary phase and the at least two washing active solid components as a solid phase;

(d) applying the laundry detergent dispersion (B) to a solid carrier substrate (C) such that the final product is a four-phase system.

2. Method for manufacturing a four-phase heavy-duty laundry detergent wipe according to claim 1, additionally comprising the step: (a') neutralizing a fatty acid to soap.

3. Method for manufacturing a four-phase heavy-duty laundry detergent wipe according to claim 1, characterized in that the liquid laundry detergent solution A is over-saturated by the soap amount.

4. Method for manufacturing a four-phase heavy-duty laundry detergent wipe according to claim 1, characterized in that the solubilizer is propyleneglycol or glycerol.

5. Method for manufacturing a four-phase heavy-duty laundry detergent wipe according to claim 1, characterized in that the first washing active solid component is a zeolite and/or phyllosilicate and the second washing active component is a bleaching agent and/or its activators.

6. Method for manufacturing a four-phase heavy-duty laundry detergent wipe according to claim 5, characterized in that the bleaching agent and/or the enzymes is surrounded by a coating substance.

7. Method for manufacturing a four-phase heavy-duty laundry detergent wipe according to claim 1, characterized in that the solid carrier substrate (C) has hydrophobic characteristics.

8. Method for manufacturing a four-phase heavy-duty laundry detergent wipe according to claim 7, characterized in that the solid carrier substrate (C) consists of a homopolymeric endless fiber.

* * * * *